US006374811B1

(12) United States Patent
Mancini

(10) Patent No.: US 6,374,811 B1
(45) Date of Patent: Apr. 23, 2002

(54) SYSTEM AND METHOD FOR MINIMIZING FUEL EVAPORATIVE EMISSIONS FROM AN INTERNAL COMBUSTION ENGINE

(75) Inventor: Douglas Joseph Mancini, Farmington, MI (US)

(73) Assignee: Ford Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/678,125

(22) Filed: Oct. 4, 2000

(51) Int. Cl.[7] ..... F02M 37/04
(52) U.S. Cl. ..... 123/519; 123/516; 123/520
(58) Field of Search ..... 123/516, 518, 123/519, 520

(56) References Cited

U.S. PATENT DOCUMENTS 4,175,526 A * 11/1979 Phelan ..... 123/520
5,924,410 A 7/1999 Dumas
5,957,114 A 9/1999 Johnson et al.
RE36,737 E 6/2000 Brehob et al.
2001/0029931 A1 * 10/2001 Burke et al. ..... 123/520

OTHER PUBLICATIONS

SAE Technical Paper 1999–01–0771—"Reduction Technologies for Evaporative Emissions in Zero Level Emission Vehicle".

* cited by examiner

*Primary Examiner*—Thomas N. Moulis
(74) *Attorney, Agent, or Firm*—Carlos L. Hanze

(57) ABSTRACT

A method for removing fuel vapors from an intake manifold of an internal combustion engine includes storing a vacuum in a vacuum storage device coupled to the intake manifold and applying the stored vacuum to the intake manifold to remove the vapors from the intake manifold.

14 Claims, 3 Drawing Sheets

SYSTEM AND METHOD FOR MINIMIZING FUEL EVAPORATIVE EMISSIONS FROM AN INTERNAL COMBUSTION ENGINE

FIELD OF THE INVENTION

The present invention relates generally to fuel vapor emission control in vehicles having internal combustion engines. More particularly, the invention relates to a system and method for removing evaporative emissions from the intake manifold of an internal combustion engine.

BACKGROUND OF THE INVENTION

Vehicles having internal combustion engines are known to release disproportionate amounts of hydrocarbons during engine cold starting and vehicle refueling. During cold starting, for example, because a stoichiometric air/fuel ratio is difficult to achieve, a higher proportion of unburned fuel vapor is delivered to the vehicle's catalytic converter thus resulting in higher concentration of hydrocarbon molecules released into the atmosphere. Similarly, during refueling, unburned fuel vapors containing such hydrocarbons are released from the vehicle's fuel tank when the fuel tank cap is removed.

As such, vehicles have been designed to include various features for minimizing the release of fuel vapor emissions during vehicle start-up and refueling. Examples of such systems are disclosed in U.S. Pat. Nos. RE 36,737, 5,924,410 and 5,957,114, which are all assigned to the assignee of the present invention. Another such system is described in co-pending U.S. application Ser. No. 09/634,618, which is also assigned to the assignee of the present invention and is hereby incorporated by reference in its entirety. The system disclosed therein includes a fuel tank that is sealed-off under vacuum when the vehicle is not being refueled. When the vehicle is refueled, a refueling detection device activates a fuel vapor valve, which is used to divert accumulated fuel vapors from the fuel tank to a fuel vapor absorption device.

A limitation of such systems, however, is that the trapping of fuel emissions is limited to refueling and engine start-up. Such systems, for example, do not take into account unburned fuel vapors that escape through other parts of the engine. One such part is the intake manifold, wherein unburned fuel and associated vapors are known to accumulate.

Accordingly, and further in light of increasingly stringent environmental standards, the inventor herein has recognized the need to minimize the amount of unburned fuel vapors accumulating in the engine's intake manifold.

SUMMARY OF THE INVENTION

The aforedescribed limitations and inadequacies of conventional fuel evaporative emission controls systems and methods are substantially overcome by the present invention, in which a method is provided for removing fuel vapors from an intake manifold of an internal combustion engine. In accordance with a preferred method of the present invention, the method includes the steps of storing a vacuum in a vacuum storage device coupled to the intake manifold and applying the stored vacuum to the intake manifold to remove the vapors from the intake manifold. Further, the method includes the steps of storing the vapors in the vacuum storage device to prevent the release of the vapors into the atmosphere and transferring the stored vapors to an on-board fuel vapor recovery system. Preferably, the vacuum storage device is the vehicle'fuel tank and the transfer of the stored emissions is performed prior to refueling of the vehicle.

An advantage of the above method is that the amount of fuel vapors accumulated in the engine's intake manifold is significantly reduced, thereby preventing the release of residual gases into the atmosphere. Such a method is thus used to control fuel evaporative emissions originating from a source other than those addressed by the prior art methods directed at minimizing emissions during engine start-up and refueling.

In accordance with another aspect of the present invention, a corresponding system is provided for minimizing fuel evaporative emissions that accumulate in the intake manifold of an internal combustion engine. The system includes a vacuum storage device, such as a vehicle fuel tank, an electronically controlled shut-down valve disposed between the vacuum storage device and the intake manifold and interconnecting the vacuum storage device and the intake manifold; and an electronic controller coupled to the shut-down valve and operable to evacuate the intake manifold of fuel evaporative emissions at a predetermined time. Advantageously, the system is further provided with a refueling/interlock valve that allows the transfer of the stored fuel vapors to an on-board fuel vapor recovery system.

Still further, in accordance with yet another aspect of the present invention, an article of manufacture is disclosed for minimizing evaporative fuel emissions of a vehicle having an internal combustion engine. The article of manufacture includes a computer usable medium and a computer readable program code embodied in the computer usable medium for directing the computer to perform the steps of storing a vacuum in a vacuum storage device coupled to the engine's intake manifold and applying the stored vacuum to the intake manifold to evacuate the vapors from the intake manifold and into the vacuum storage device.

Further objects, features and advantages of the invention will become apparent from the following detailed description taken in conjunction with the accompanying figures showing illustrative embodiments of the invention.

BRIEF DESCRIPTION OF THE DRAWINGS

For a complete understanding of the present invention and the advantages thereof, reference is now made to the following description taken in conjunction with the accompanying drawings in which like reference numbers indicate like features and wherein.

DETAILED DESCRIPTION OF THE PREFERRED EMBODIMENTS

Figure 1:
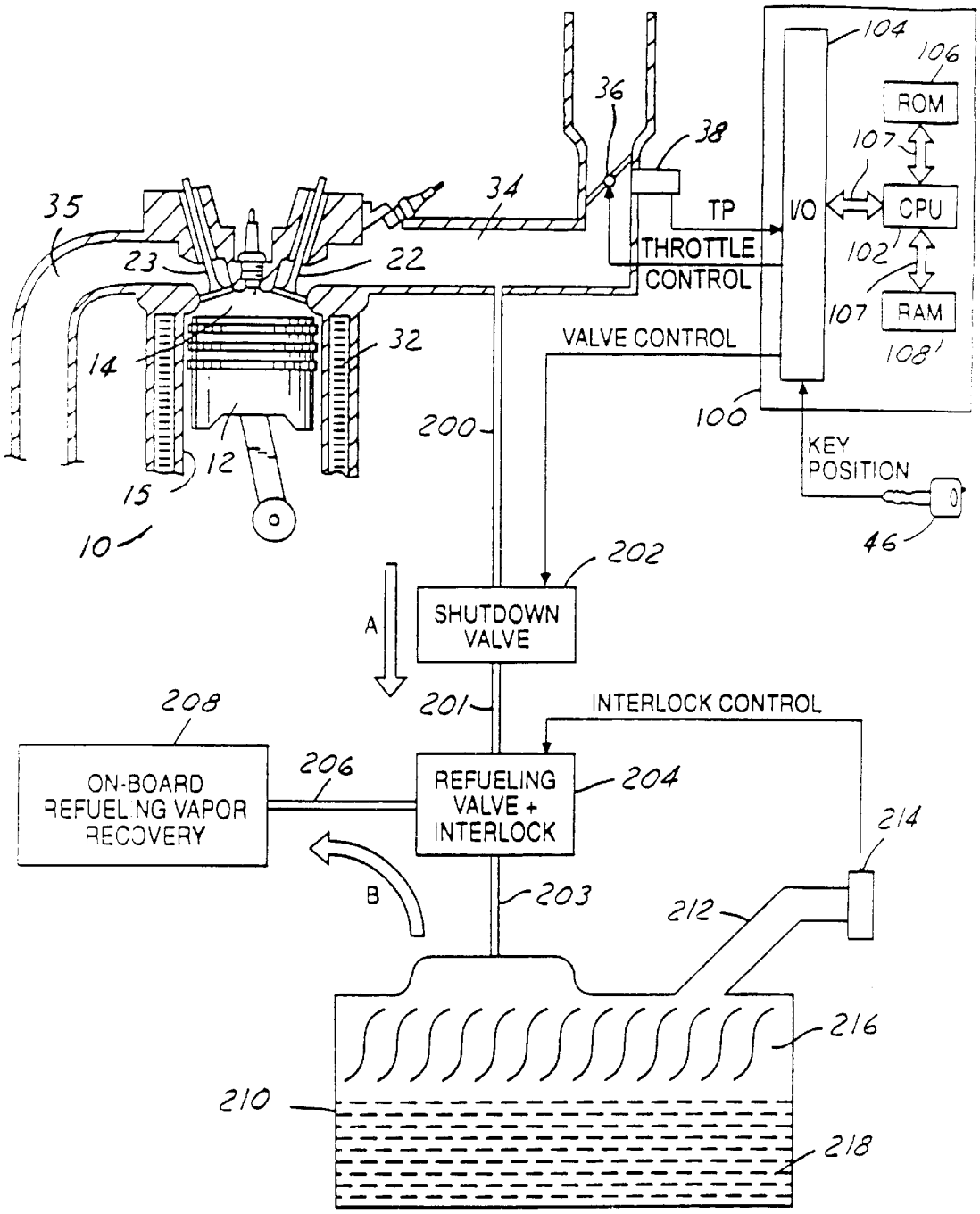
FIG. 1 is a diagram of an internal combustion engine having a system for minimizing fuel evaporative emissions in accordance with a preferred embodiment of the present invention.

FIG. 1 shows a diagram of an internal combustion engine 10 having a system for minimizing fuel evaporative emissions such as hydrocarbons. By way of example not limitation, the engine 10 of FIG. 1 is a four-stroke direct fuel injection (DFI) internal combustion engine having a plurality of cylinders (only one shown), each cylinder having a combustion chamber 14 and cylinder walls 15 in cooperation with a reciprocating piston 12 positioned therein and coupled to a crankshaft. The combustion chamber 14 communicates with corresponding intake and exhaust manifolds 34 and 35, respectively, via intake and exhaust valves 22 and 23. An electronic engine controller 100 is provided for controlling engine operation, the controller 100 including a central processing unit (CPU) 102, input/output ports 104, random access memory (RAM) 108, read-only memory (ROM) 106 and a data bus 107. The engine controller 100 is further coupled to a throttle valve 36 and throttle valve position sensor 38 disposed within an intake manifold 34 of the engine, and also includes a computer program embodied in the computer memory 106 and 108 for implementing the method of the present invention as described below with reference to FIGS. 2 through 4.

The engine's intake manifold 34 is coupled to a vacuum storage device 210, shown by way of example in FIG. 1 as the vehicle'fuel tank, via fuel vapor conduits 200, 201 and 203, and first and second electronically controlled valves 202 and 204. As shown, the fuel vapor conduit 200 is connected to the intake manifold 34 at one end and to the first or "shutdown" valve 202 at the other. The shutdown valve 202 is further connected via another fuel vapor conduit 201 to the second "refueling/interlock" valve 204, which in turn is connected to the fuel tank 210 via fuel conduit 203. An on-board refueling vapor recovery system 208, which preferably includes an evaporative emissions canister, is further provided containing one or more fuel vapor adsorbing materials such as activated carbon particles.

Figure 2:
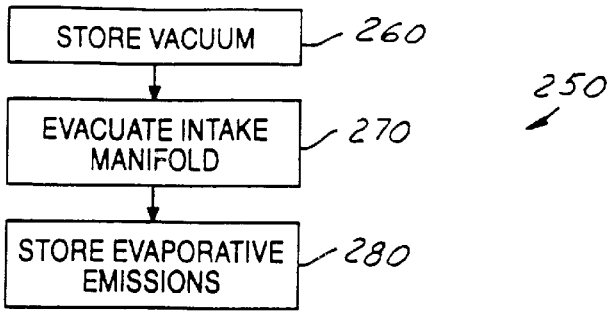
FIG. 2 is a flow diagram showing a preferred method of the present invention for removing fuel vapors from the intake manifold of an internal combustion engine.

The system of FIG. 1 functions generally in accordance with the method as shown in FIG. 2. While the engine 10 is operating, a vacuum or pressure differential is created and stored in the vacuum storage device, step 260. The stored vacuum, typically at 5 to 10 psi, can be created and stored as required by any conventional means known and understood by those of skill in the art. Using one or more of the valves 202 and 204, the stored vacuum is then used to evacuate the intake manifold 34 at an optimal time after engine shutdown, step 270. Preferably, the optimal time occurs when the temperature inside the intake manifold is at its highest or near its maximum, i.e., a time during which the partial pressure of the fuel contained within the intake manifold is at its highest.

Thus, the evacuation of the intake manifold in accordance with the present invention prevents the diffusion and migration of hydrocarbon molecules from the intake manifold to the environment. In addition, the evacuated hydrocarbon molecules can be transferred and stored in an emissions absorbing device, step 280.

Figure 3:
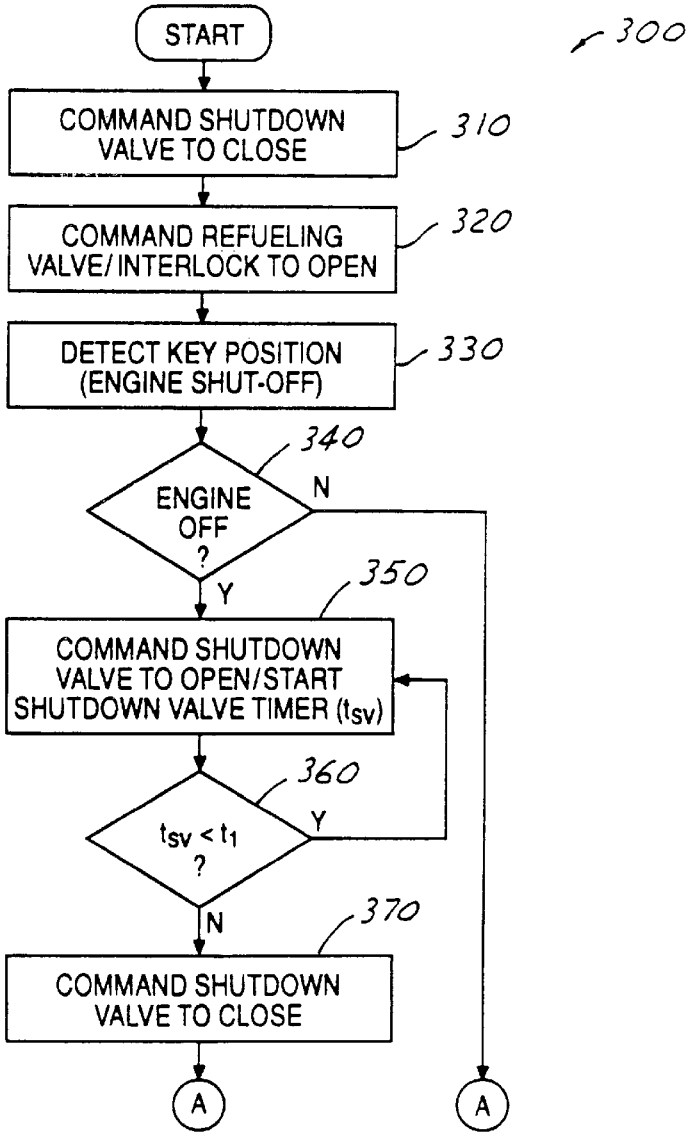
FIG. 3 is a flow diagram showing another preferred method of the present invention for removing fuel vapors from the intake manifold of an internal combustion engine.
Figure 4:
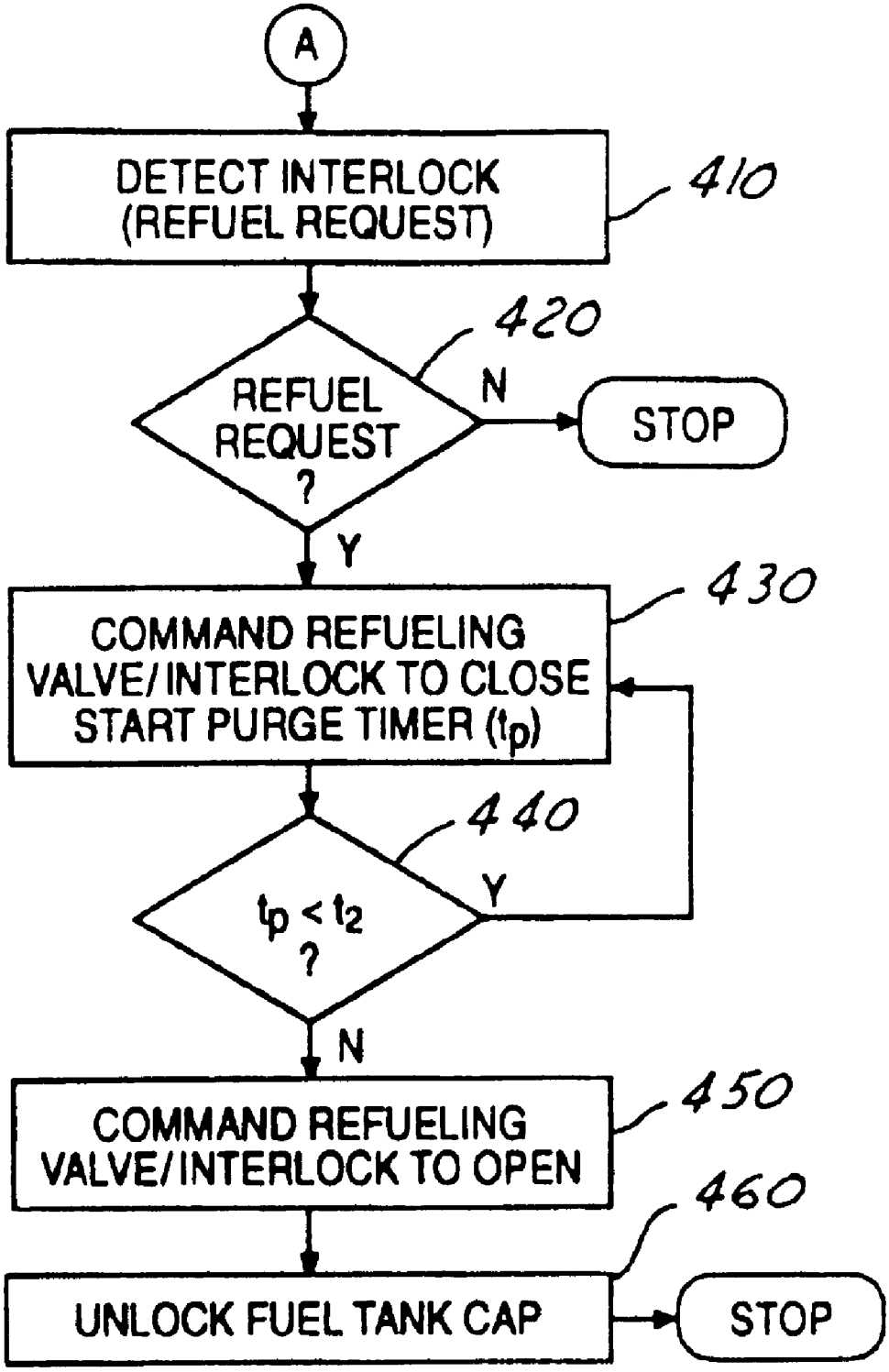
FIG. 4 is a flow diagram showing a preferred method of the present invention for transferring stored fuel vapors to an on-board fuel vapor recovery system prior to refueling of a vehicle fuel tank.

FIGS. 3 and 4 are flowcharts further showing the operation of the system of FIG. 1. Prior to engine operation, the controller 100 commands the shutdown valve 202 to a closed position and the refueling valve/interlock 204 to an open position, step 310 and 320. After the engine is running, a check is done to determine whether the engine has been disabled, step 340. The check can be done, for example, by monitoring the position of the vehicle key 46 or by monitoring the engine speed (speed sensor not shown), step 330. If the engine is disabled, then the shutdown valve 202 is commanded to the open position and a shutdown valve timer $t_{sv}$ activated, step 350. The valve is then commanded or held open for a first predetermined period of time $t_1$, during which the intake manifold is evacuated of residual hydrocarbon molecules along path A, steps 350 and 360. The intake manifold is thus replenished with clean air from the air induction system of the engine and outside the vehicle.

The time $t_1$, in accordance with the present invention depends on the magnitude of the vacuum stored in the vacuum storage device/fuel tank 210, and nominally ranges between 2 and 5 seconds for stored vacuums ranging between 10 to 20 inches of mercury. When the timer equals or exceeds $t_1$, step 360, then the shutdown valve 202 is commanded to the closed position, step 370.

Thus, at the optimal time the electronic controller opens the shutdown valve, allowing air to flow from the intake manifold to the fuel tank, the airflow having a fuel vapors containing a high concentration of hydrocarbon. Advantageously, the opening and closing of the shutdown valve is controlled so as to use minimal vacuum and to maintain a vacuum inside the fuel tank. The vacuum inside the fuel tank allows any system leaks to leak inward preventing the release of fuel vapor into the atmosphere. Preferably, since hydrocarbon vapors in particular are heavier than air, the evacuation occurs at the lowest point in the cylinder head or intake manifold. In this manner, residual liquids can also be evacuated.

Next, as shown in FIG. 4, hydrocarbon molecules evacuated into the fuel tank can be further transferred to the evaporative emissions canister. Preferably, this is done after the engine has been turned off. In accordance with step 410, a refueling request is detected by the presence of an interlock control signal, step 420, which can be generated by a controller via a push-button switch or other mechanism coupled to the fuel tank cap. If the refueling request is detected, then the refueling valve/interlock is commanded to the closed position timer and a purge timer $t_p$ is initiated, step 430. The refueling valve/interlock is held closed for a second predetermined period of time $t_2$, nominally 1 to 10 seconds, in accordance with step 440. During the period $t_2$, the fuel vapors accumulated in the fuel tank are transferred through conduits 203 and 206 along the path shown by arrow B into the on-board vapor recovery system 208. The refueling valve/interlock is then closed, step 450, and the fuel tank cap unlocked so as to allow refueling of the vehicle, step 460.

Referring again to FIG. 1, alternatively, the engine 10 can include one or more vacuum ports in communication with each cylinder intake runner and located close to the intake valve to enhance the evacuation process. Also, preferably the vacuum storage device is purged during the next drive cycle so as to consume the fuel vapor contained in it and to replenish the vacuum supply.

Although the present invention has been described in connection with particular embodiments thereof, it is to be understood that various modifications, alterations and adaptations may be made by those skilled in the art without departing from the spirit and scope of the invention. It is intended that the invention be limited only by the appended claims.

What is claimed is:

1. A method for removing fuel vapors from an intake manifold of an internal combustion engine, comprising:

storing a vacuum in a vacuum storage device coupled to the intake manifold; and applying the stored vacuum to the intake manifold to remove the vapors from the intake manifold.

2. The method according to claim 1, further comprising the step of storing the vapors in the vacuum storage device to prevent the release thereof into the atmosphere.

3. The method according to claim 1, wherein said vacuum storage device is a fuel tank and wherein said storing step comprises storing said vapors in said fuel tank.

4. The method according to claim 3, further comprising the step of transferring said stored vapors to an on-board fuel vapor recovery device.

5. A method for minimizing evaporative fuel emissions of a vehicle having an internal combustion engine with an intake manifold, the vehicle having a vacuum storage device and an on-board fuel vapor recovery system, said method comprising:

storing a vacuum in the vacuum storage device coupled to the intake manifold; and applying the stored vacuum to the intake manifold to evacuate the vapors from the intake manifold and into the vacuum storage device.

6. The method according to claim 5, further comprising the step of transferring the evacuated fuel vapors to the on-board fuel vapor recovery system from the vacuum storage device prior to refueling of the vehicle.

7. A method for minimizing evaporative fuel emissions of a vehicle having an internal combustion engine with an intake manifold and an electronic engine controller, the vehicle having a vacuum storage device, an on-board fuel vapor recovery system, said method comprising:

detecting whether the engine has been disabled; and if the engine has been disabled, commanding a first electronically-controlled valve connected to the intake manifold for coupling the intake manifold to the vacuum storage device, and a second electronically-controlled valve connected to the first valve for coupling the vacuum storage device to the an on-board fuel vapor recovery system, to create a flow of air from the intake manifold through said first and second valves and into the vacuum storage device so as to evacuate the intake manifold of hydrocarbon fuel vapors containing hydrocarbon emissions.

8. The method according to claim 7, further comprising:

detecting a request to refuel the vehicle;

commanding the second valve, based on the detected refueling request, to enable a flow of fuel vapors from the vacuum storage device to the on-board fuel vapor recovery system.

9. The method according to claim 8, wherein the vacuum storage device is vehicle fuel tank having a fuel tank cap, said method further comprising the step of unlocking the fuel tank cap after the flow of fuel vapors from the vacuum storage device to the on-board fuel vapor recovery system has been enabled.

10. A system for minimizing fuel evaporative emissions of a vehicle having an internal combustion engine with an intake manifold wherein fuel vapors accumulate during operation of the engine, said system comprising:

a vacuum storage device;

an electronically-controlled shut-down valve coupled to the intake manifold for enabling a flow of fuel vapors from the intake manifold to the vacuum storage device; and an electronic controller coupled to said shutdown valve and operable to evacuate the intake manifold of fuel evaporative emissions at a predetermined time.

11. The system according to claim 10, further comprising;

an on-board fuel vapor recovery system; and an electronically-controlled refueling valve coupled to the vacuum storage device for enabling a flow of stored fuel vapors from the vacuum storage device to the on-board fuel vapor recovery system.

12. The system according to claim 11, further comprising electronic means for generating a control signal for said refueling valve.

13. The system according to claim 11, wherein said vacuum storage device is a vehicle fuel tank having a fuel tank cap, the system further comprising means coupled to said fuel tank cap for controlling said refueling valve.

14. An article of manufacture for minimizing evaporative fuel emissions of a vehicle having an internal combustion engine, the internal combustion engine having an intake manifold and a vacuum storage device coupled thereto, the article of manufacture comprising:

a computer usable medium; and a computer readable program code embodied in the computer usable medium for directing the computer to perform the steps of storing a vacuum in the vacuum storage device coupled to the intake manifold and applying the stored vacuum to the intake manifold to evacuate the vapors from the intake manifold and into the vacuum storage device.

* * * * *